US012638267B1

(12) United States Patent
Janczura et al.

(10) Patent No.: US 12,638,267 B1
(45) Date of Patent: May 26, 2026

(54) SELF-CONTAINED FIREARM BRACE

(71) Applicant: Tyrant Designs CNC, LLC, Chicago, IL (US)

(72) Inventors: Thomas Janczura, Chicago, IL (US); Brent Brubaker, Murfreesboro, TN (US); Christopher Greenwalt, Chicago, IL (US)

(73) Assignee: Tyrant Designs CNC, LLC, Chicago, IL (US)

( * ) Notice: Subject to any disclaimer, the term of this patent is extended or adjusted under 35 U.S.C. 154(b) by 0 days.

(21) Appl. No.: 19/219,748

(22) Filed: May 27, 2025

(51) Int. Cl.
*F41C 23/04* (2006.01)
*F41C 23/12* (2006.01)

(52) U.S. Cl.
CPC ..... *F41C 23/04* (2013.01); *F41C 23/12* (2013.01)

(58) Field of Classification Search
CPC ..... F41C 23/12; F41C 23/04; F41A 23/10
USPC ..... 42/72, 73, 71.02
See application file for complete search history.

(56) References Cited

U.S. PATENT DOCUMENTS

| | | | | |
|---|---|---|---|---|
| 8,448,366 | B2 * | 5/2013 | Faifer | F41G 11/003 42/72 |
| 10,704,848 | B1 * | 7/2020 | Zeider | F41A 3/66 |
| 11,725,902 | B2 * | 8/2023 | Underwood | F41C 23/04 42/71.01 |
| 11,906,263 | B2 * | 2/2024 | Underwood | F41C 23/04 |
| 2019/0093983 | A1 * | 3/2019 | Bruegger | F41C 23/12 |

FOREIGN PATENT DOCUMENTS

| | | | | |
|---|---|---|---|---|
| EP | 3825644 | A1 * | 5/2021 | F41C 23/12 |

* cited by examiner

*Primary Examiner* — Reginald S Tillman, Jr.
(74) *Attorney, Agent, or Firm* — Benjamin D. Rotman; UB Greensfelder LLP

(57) ABSTRACT

A self-contained foldable firearm brace assembly comprising a firearm coupling, a side fold arm rotatably attached to the coupling, and a release paddle mechanism that allows the side fold arm to lock into open or closed positions. An elastic member is integrated to assist in the automatic deployment of the side fold arm when the locking mechanism is disengaged.

18 Claims, 6 Drawing Sheets

Fig. 7
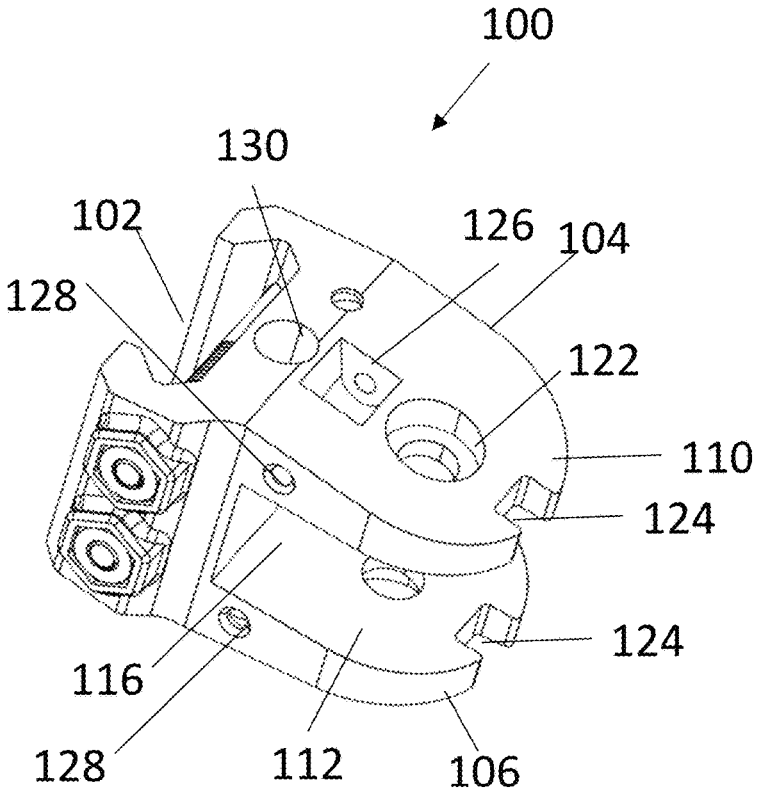
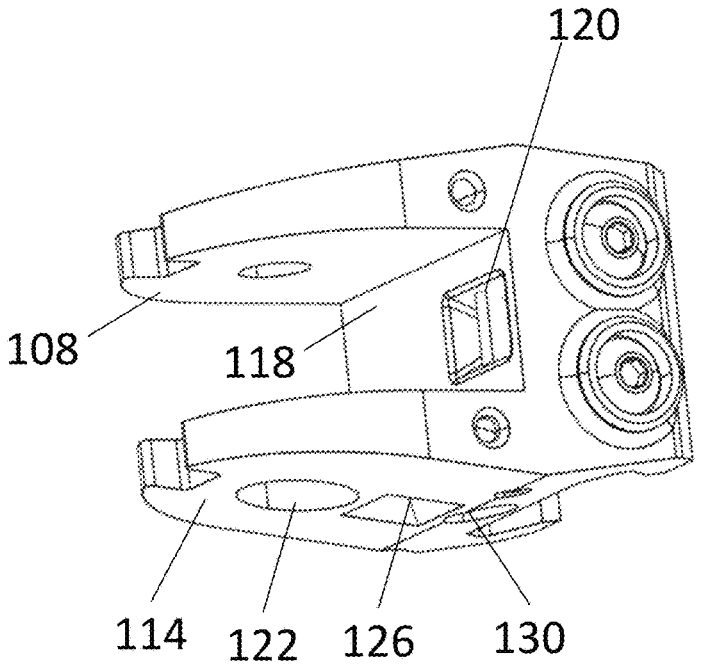
Fig. 8

SELF-CONTAINED FIREARM BRACE

BACKGROUND OF THE INVENTION

The present invention generally relates to firearm braces or buttstocks. More particularly the present invention relates a self-contained foldable firearm brace.

Firearm buttstock braces, also known as stabilizing braces or arm braces, have become increasingly popular among firearm users, particularly for pistols and short-barreled rifles. These devices are designed to enhance the stability and control of a firearm by providing an additional point of contact between the shooter and the weapon. Typically mounted at the rear of the firearm, the brace extends to rest against the user's forearm or shoulder, thereby improving accuracy and reducing recoil.

Despite their functional benefits, conventional buttstock braces often suffer from significant drawbacks related to portability and bulkiness. Many existing designs are rigid, non-collapsible, or only minimally adjustable, which can make them cumbersome to transport and store. Their fixed or semi-fixed configurations can add considerable length and weight to the firearm, limiting their practicality for users who require compactness-such as law enforcement personnel, military operators, or civilian users engaged in outdoor activities like hiking or hunting.

Furthermore, the bulkiness of traditional braces can interfere with the maneuverability of the firearm in confined spaces, such as vehicles or indoor environments. This can be particularly problematic in tactical or emergency scenarios where agility and rapid deployment are critical. The lack of modularity and adaptability in current brace designs also restricts their compatibility with a wide range of firearm platforms and user preferences.

The present invention attempts to remedy the shortcomings of these prior braces by providing a self-contained fold-able brace.

SUMMARY OF THE INVENTION

In view of the above, a self-contained foldable firearm brace is disclosed. The self-contained foldable firearm brace assembly comprises a firearm coupling, a side fold arm rotatably attached to the coupling, and a release paddle mechanism that allows the side fold arm to lock into open or closed positions. An elastic member is integrated to assist in the automatic deployment of the side fold arm when the locking mechanism is disengaged.

In one aspect, the firearm coupling features a rear coupling feature, such as a picatinny rail interface or other standard firearm attachment systems, and includes upper and lower side arm coupling members that define a slot for receiving the side fold arm. These coupling members are configured with coaxial openings to accommodate a fastener, as well as slots and openings for the release paddle and its associated biasing member.

In another aspect, the side fold arm includes a proximal end with a coupling member and a distal end with a rear brace. The coupling member is designed to interface with the firearm coupling and includes locking slots for both open and closed positions. An elastic member channel and optional shield are also integrated into the side fold arm to house and protect the elastic member.

In another aspect, the release paddle includes an actuator, a locking member, and a pivot member. When assembled, the release paddle is biased into a locked position by a spring, securing the side fold arm in either the open or closed configuration. Depressing the actuator disengages the locking member, allowing the elastic member to rotate the side fold arm into the open position automatically.

BRIEF DESCRIPTION OF THE DRAWINGS

In the accompanying figures, like elements are identified by like reference numerals among the several preferred embodiments of the present invention.

FIG. 7 illustrates an example firearm coupling in a top perspective view.

FIG. 8 illustrates an example firearm coupling in a bottom perspective view.

Other aspects and advantages of the present invention will become apparent upon consideration of the following detailed description, wherein similar structures have similar reference numerals.

DETAILED DESCRIPTION OF THE PREFERRED EMBODIMENTS

The foregoing and other features and advantages of the invention will become more apparent from the following detailed description of an exemplary embodiment, read in conjunction with the accompanying drawings. The detailed description and drawings are merely illustrative of the invention rather than limiting, the scope of the invention being defined by the appended claims and equivalents thereof.

Figure 1:
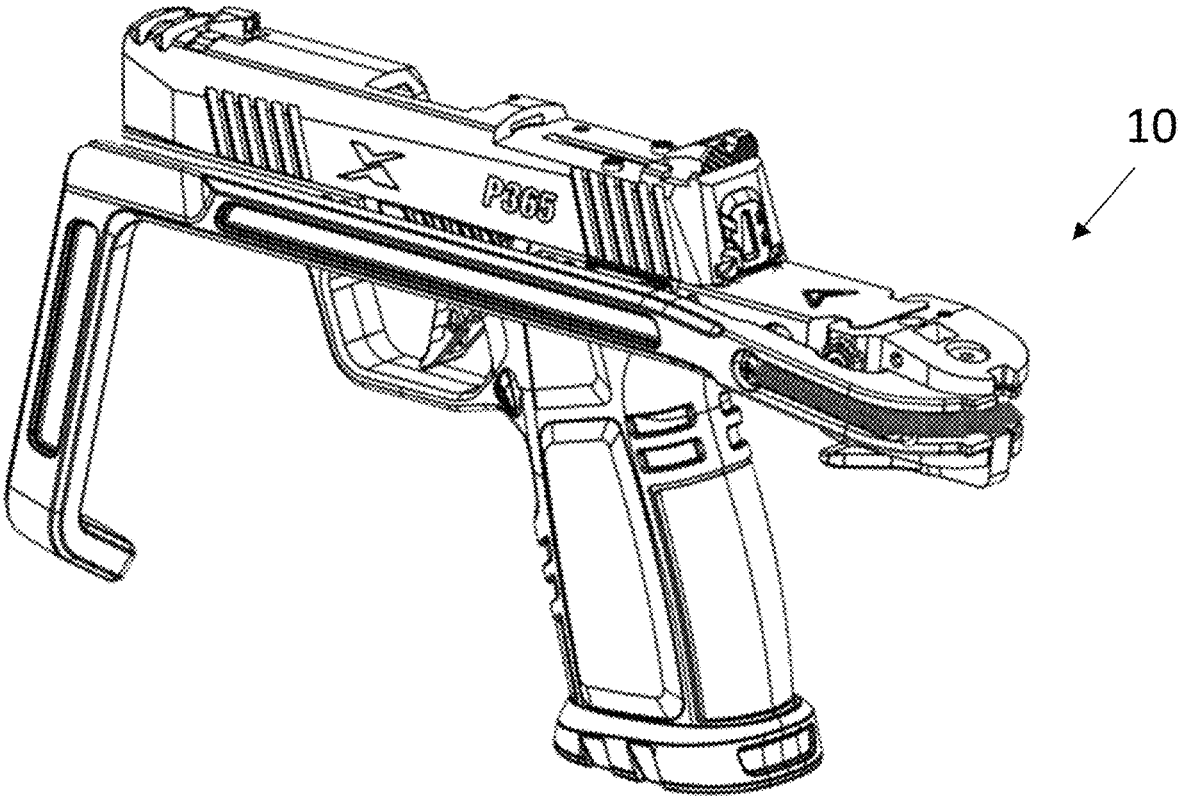
FIG. 1 illustrates an example firearm brace assembly in a closed assembly position.
Figure 2:
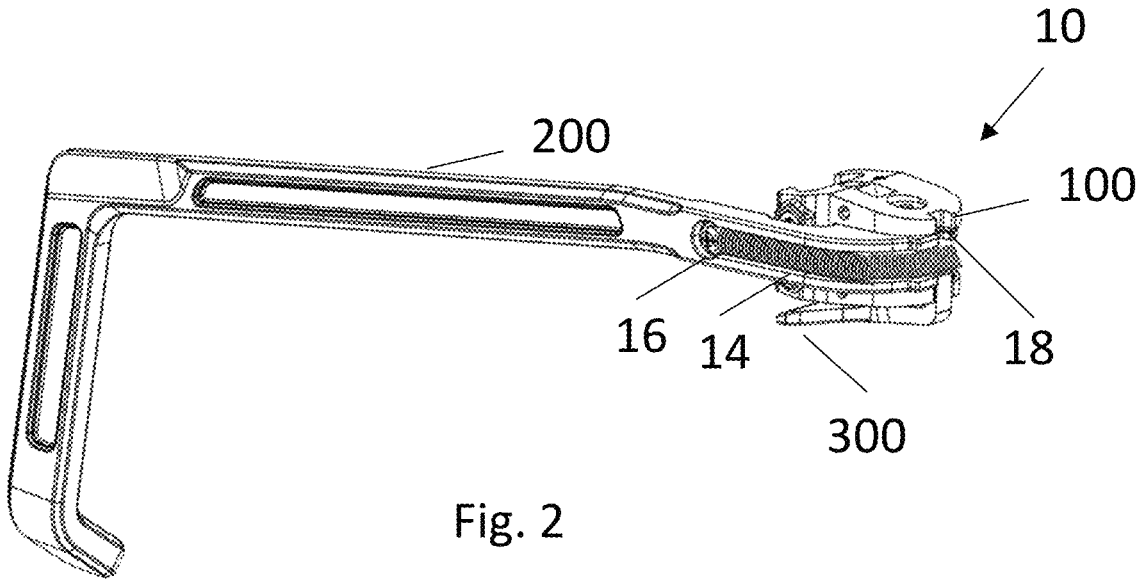
FIG. 2 illustrates an side view of the firearm brace assembly in a closed assembly position.
Figure 3:
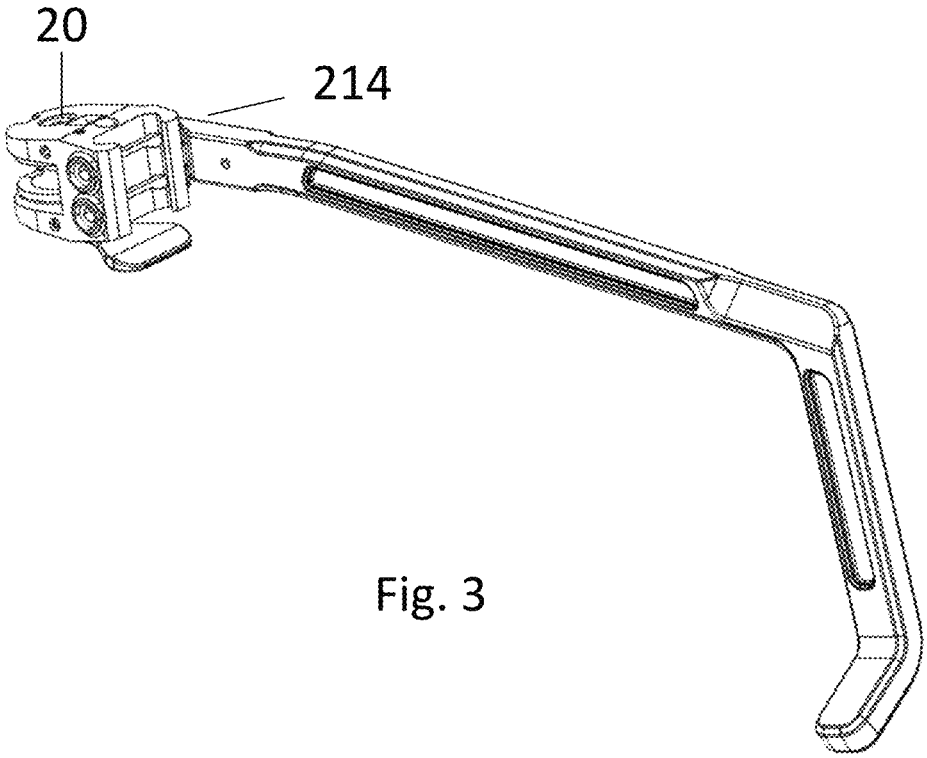
FIG. 3 illustrates an additional side view of the firearm brace assembly in a closed assembly position.
Figure 4:
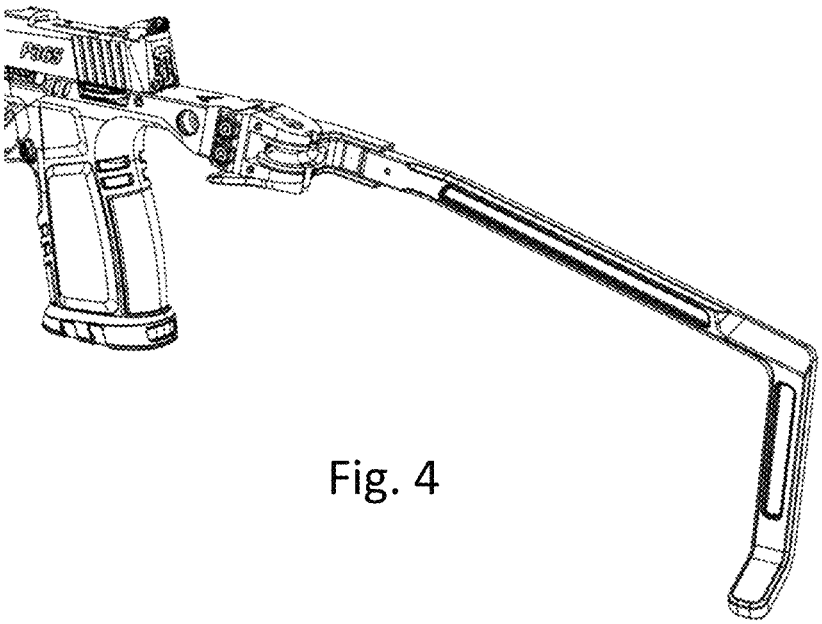
FIG. 4 illustrates an example firearm brace assembly in an open assembly position.
Figure 5:
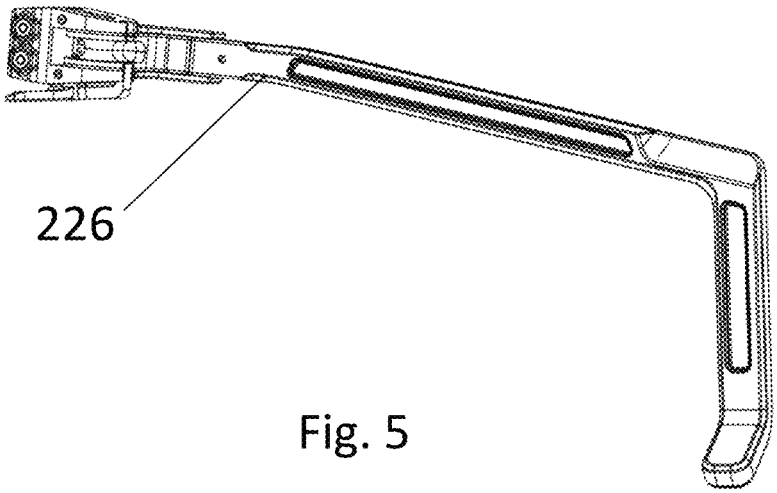
FIG. 5 illustrates an side view of the firearm brace assembly in an open assembly position.
Figure 6:
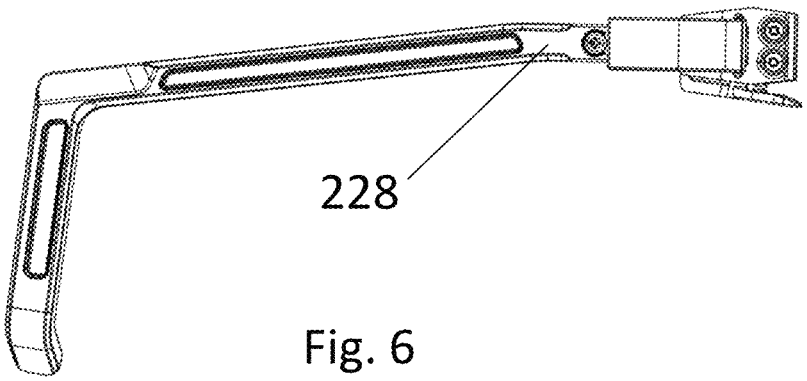
FIG. 6 illustrates an additional side view of the firearm brace assembly in an open position.

FIGS. 1-3 represent the firearm brace assembly 10 in closed positions and FIGS. 4-6 represent the firearm brace assembly 10 in open positions. The firearm brace assembly 10 comprises a firearm coupling 100, a side fold arm 200 rotateably coupled to the firearm coupling 100, a release paddle 300 coupled to the firearm coupling 200, a release paddle biasing member 12 coupled to the release paddle 300 and the firearm coupling 100 configured to bias the release paddle into a locked position, an elastic member 14 coupled to the side fold arm 200 at a first end 16 and the firearm coupling 100 at a second end 18.

FIG. 7 and FIG. 8 represent top and bottom perspective views of the firearm coupling 200. The firearm coupling 100 comprises a rear coupling feature 102, a first side arm coupling member 104 extending from a firearm coupling top portion and a second side arm coupling member 106 extending from a firearm coupling bottom portion. The rear coupling feature 102 may comprise a picatinny rail interface and fasteners or other common firearm coupling interfaces such a snap or threaded interface. The first side arm coupling member 104 comprises a first side arm coupling member inner surface 108 and first side arm coupling member outer surface 110. The second side arm coupling member 106 comprises a second side arm coupling member inner surface 112 and second side arm coupling member inner outer surface 114. The firearm coupling 100 further comprises a side arm coupling slot 116 spaced between the first side arm coupling member inner surface 108 and second side arm coupling member inner surface 112 by a coupling member spacing wall 118. In this configuration, the side arm coupling slot 116 is configured to accommodate the side arm coupling member 210 and the coupling member spacing wall 118 further comprises an elastic member coupling feature 120. The first side arm coupling member 104 and the second side arm coupling member 106 each include a side fold arm axial opening 122 aligned coaxially and configured to accommodate the side arm coupling fastener 20. Further, the first side arm coupling member 104 and the second side arm coupling member 106 each include a release paddle locking slot 124, a release paddle opening 126, and release paddle axle openings 128. The firearm coupling 100 further comprises a release paddle biasing member opening 130 disposed in the top portion of the firearm coupling 100 and in the bottom portion of a top portion of the firearm coupling 100. One of skill in the art would recognize the mirrored feature set on the top and bottom portions of the firearm coupling 100 allowing for assembly on either side and either configuration. In some aspects, the firearm coupling 100 is not reversible and the release paddle opening 126, release paddle assembly axle openings 128, release paddle biasing member opening 130, the coupling member open position locking slot 124, and a coupling member closed position locking slot 126, only exist in the second side arm coupling member 106.

Figure 9:
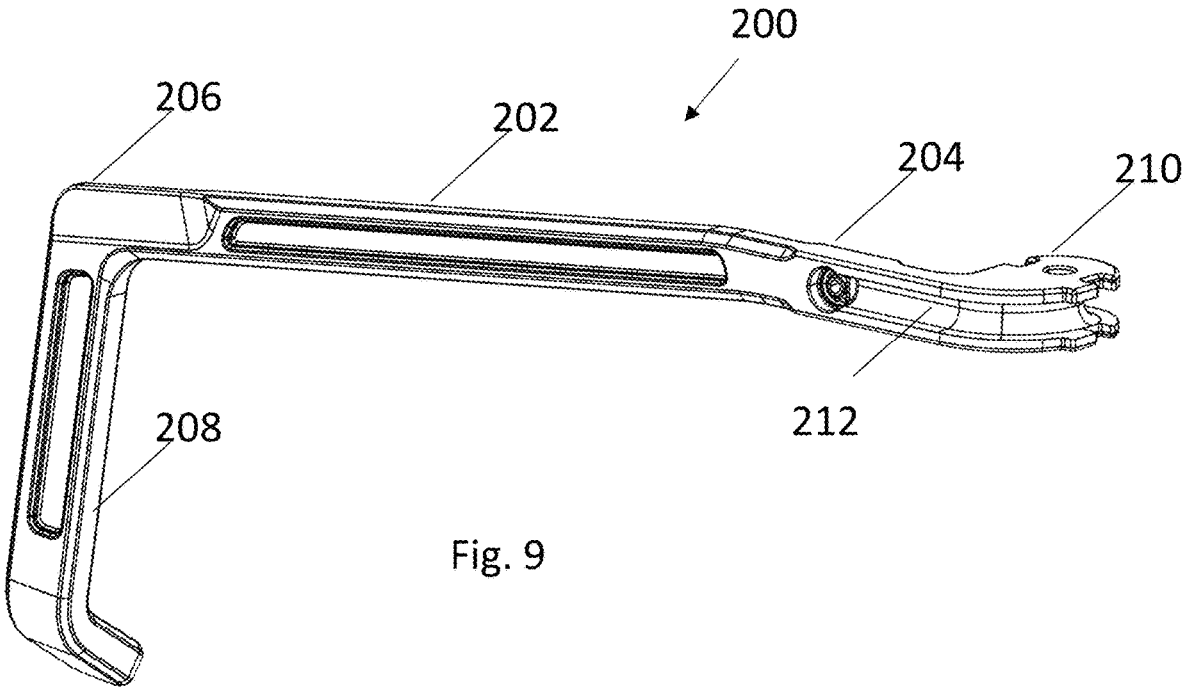
FIG. 9 illustrates an example firearm side folding member.
Figure 10:
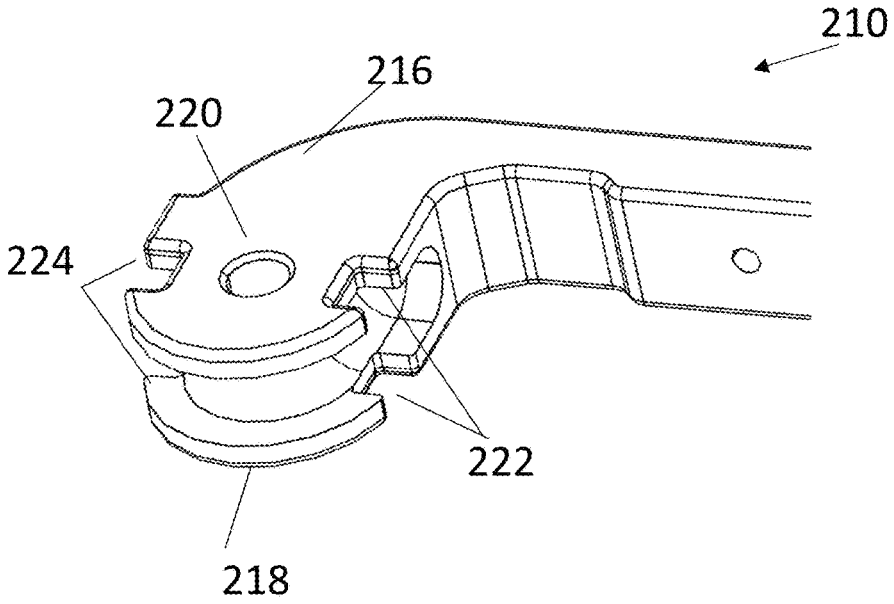
FIG. 10 illustrates an example firearm side folding member coupling.

As shown in FIG. 9 and FIG. 10, the side fold arm 200 comprises an elongated arm 202 having a proximal end 204 and a distal end 206, a rear brace member 208 extending from the distal end 206 a side arm coupling member 210 extending from the proximal end 204, and an clastic member channel 212 disposed in the proximal end 204. In some aspects, side fold arm 200 further comprises an elastic member shield 214 coupled to the side fold arm 200 configured to shield the elastic member 14. The side arm coupling member 210 comprises a side arm coupling member top surface 216, a side arm coupling member bottom surface 218, side arm coupling member opening 220 traversing the side arm coupling member top surface 216 and side arm coupling member bottom surface 218 configured to accommodate a side arm coupling fastener 20 including but not limited to a binding screw. The side arm coupling member 210 further comprises a side arm open position locking slot 222 and a side arm closed position locking slot 224 in each of the side arm coupling member top surface 216 and a side arm coupling member bottom surface 218 configured to accommodate release paddle 300. In aspects where the side fold arm 200 is not reversible, the open position locking slot 222 and a closed position locking slot 224 are only disposed in the side arm coupling member bottom surface 218.

Figure 11:
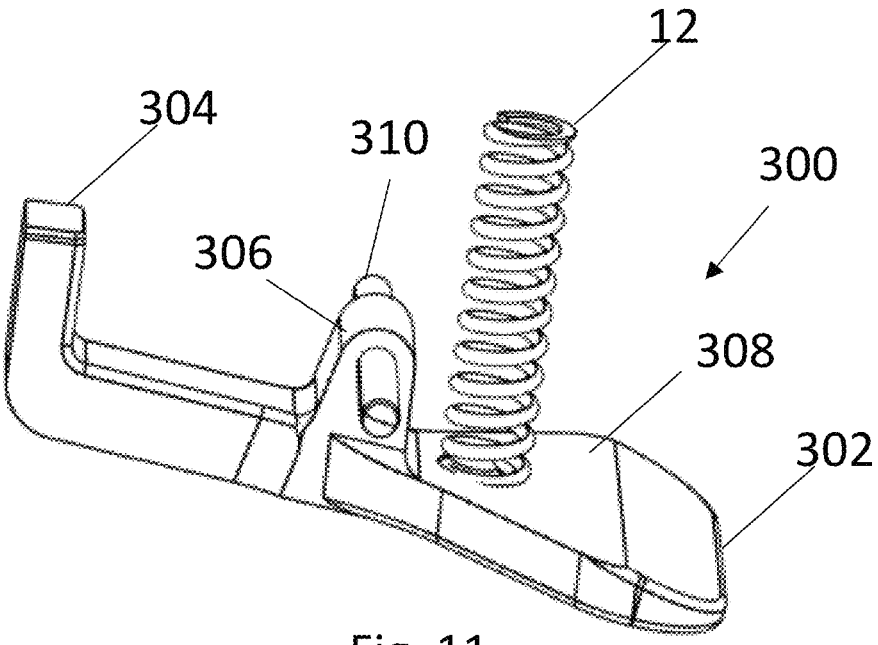
FIG. 11 illustrates an example release paddle.
Figure 12:
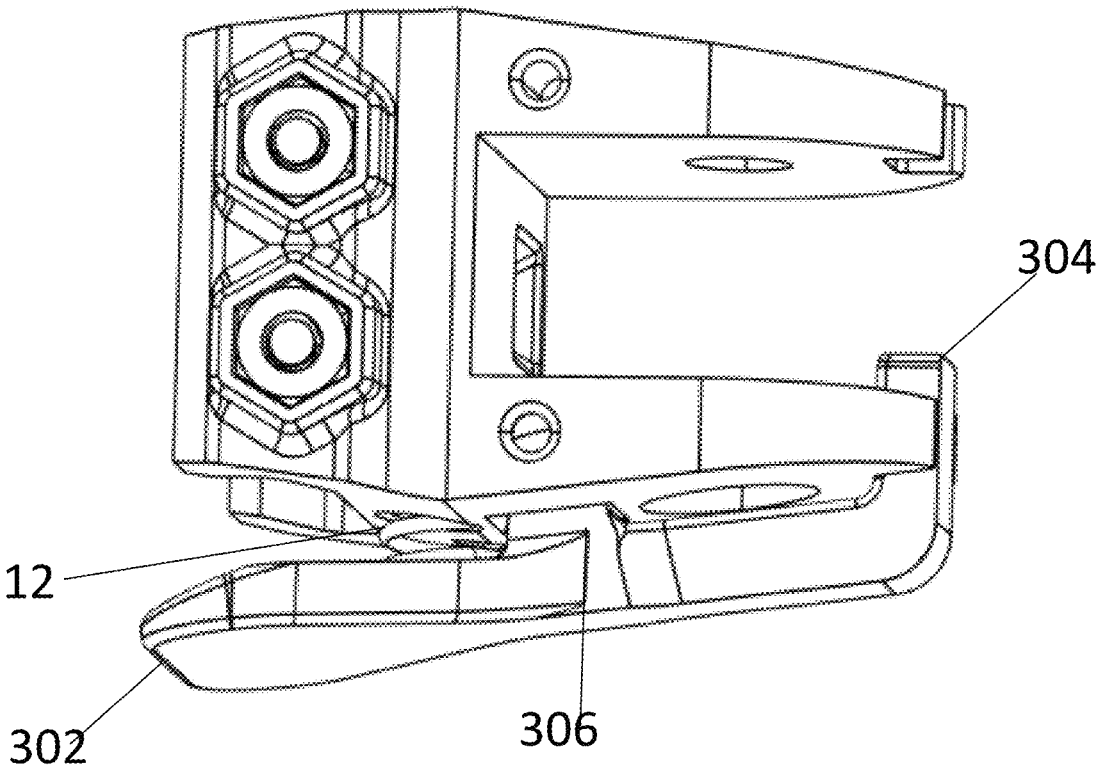
FIG. 12 illustrates an example release paddle assembled into the firearm coupling.

As shown in FIG. 11 and FIG. 12 the release paddle 300 comprises a release paddle actuator 302, a release paddle locking member 304, a release paddle pivot member 306, a release paddle actuator biasing surface 308, and a release paddle coupling axle 310.

As assembled, the side arm coupling member 210 is rotatably coupled in between The first side arm coupling member 104 and the second side arm coupling member 106 through the side arm coupling fastener 20. The elastic member 14 is disposed within the clastic member channel 212 and coupled to the side fold arm 200 at a first end 16 and the firearm coupling 200 at a second end 18 to the elastic member coupling feature 120. The release paddle pivot member 306 is disposed into a release paddle opening 126 and pivotally coupled to the firearm coupling 100 through the release paddle axle openings 128 along the release paddle coupling axle 310. The release paddle biasing member 12 is assembled into the release paddle biasing member opening 132 and coupled to the release paddle actuator biasing surface 308 and the release paddle locking member 304 is disposed within the release paddle locking slot 124 and either the side arm open position locking slot 222 or the side arm closed position locking slot 224.

In a closed position, the side fold arm 200 is rotated such that the distal end 206 is pointing towards the firearm. In this position, the elastic member 14 is in tension and the side fold arm 200 is fixed in place by the release paddle locking member 304 being disposed within side arm closed position locking slot 224. The release paddle locking member 304 limits rotational movement of the side fold arm 200. In a transition state, the release paddle actuator 302 is depressed, compressing the release paddle biasing member 12 and rotating the release paddle locking member 304 out of the side arm closed position locking slot 224. In this state, the side fold arm 200 is no longer rotationally constrained and the elastic member 14 rotates the side fold arm 200 into an open position in which the elastic member 14 is no longer in tension. Once the release paddle actuator 302 is released, the release paddle biasing member 12 rotates the release paddle locking member 304 back, however, in an open position the side fold arm 200 has rotated and the side arm open position locking slot 222 is engaged.

It should be recognized by one of skill in the art that the elastic member 14 may be a spring, elastic band, or other resilient material configured to be tensioned when stretched and elastically return to form when a tension force is released.

In one aspect as shown in the collection of figures, the firearm brace assembly 10 is configured for reversibility depending on whether the user is right handed or left handed. The coupling member 100, for example, shows all features in parody with each other such that the coupling member 100 can be assembled upside down and the release paddle 300 can be assembled on the top or bottom surface of the coupling member 100. In some examples the clastic member coupling feature 120 is horizontally centered within the coupling member spacing wall 118, while in other examples the elastic member coupling feature 120 is disposed horizontally off-center within the coupling member spacing wall 118 to adjust the stretch length and tension of the clastic member 14. Flipping the coupling member 100 will adjust that stretch length and may provide for a faster or slower extension of the side fold arm 200. In some instances the side arm coupling member 210 extends from a side fold arm first side 226 of the corresponding to a right handed assembly or first coupled orientation. In some instances the side arm coupling member 210 extends from a side fold arm second side 228 of the corresponding to a left handed assembly or second coupled orientation. Further in some instances, the side arm coupling member 210 is removably coupled to the side fold arm 200 and can be flipped and assembled to extend from either the side fold arm first side 226 or the side fold arm second side 228. In these instances, the clastic member channel 212 may be extended on either the either the side fold arm first side 226 or the side fold arm second side 228 to accommodate the reversed assembly. In yet another aspect, the rear brace member 208 is removably coupled to the side fold arm 200 and can be flipped and assembled to allow for different support positions or right handed or left handed orientations. In this aspect, the rear brace member 208 may also be rotatably coupled to the side folding arm 200 such that rear brace 208 can be locked in a brace position or locked in a rotated and folded stored position. One of skill in the art would recognize that the removable rear brace 208 or removable side arm coupling member 210 may be coupled by any common mechanical coupling means including but not limited to screws or snaps.

Those of ordinary skill in the art will understand and appreciate the aforementioned description of the invention has been made with reference to a certain exemplary embodiment of the invention, which describe a self-contained foldable brace and method of use. Those of skill in the art will understand that obvious variations in construction, material, dimensions or properties may be made without departing from the scope of the invention which is intended to be limited only by the claims appended hereto.

The invention claimed is:

1. A firearm brace assembly comprising:

a side fold arm having a side fold arm proximal end and side fold arm distal end, a side arm coupling member extending from the side fold arm proximal end, and a rear brace member extending from a distal end;

a firearm coupling having a rear coupling feature configured to couple to a firearm, a first side arm coupling member extending from a firearm coupling top portion, a second side arm coupling member extending from a firearm coupling bottom portion, the first side arm coupling member and second side arm coupling member spaced apart by a coupling member spacing wall forming a sider arm coupling slot configured to accommodate the side arm coupling member;

the side arm coupling member rotatably coupled between the first side arm coupling member and second side arm coupling member;

an elastic member coupled to the side fold arm proximal end and the firearm coupling;

a release paddle coupled to the firearm coupling, the release paddle comprising a release paddle actuator, a release paddle locking member, a release paddle pivot member; and a release paddle biasing member coupled to the release paddle and the firearm coupling, the release paddle biasing member biasing the release paddle into a locked position.

2. The firearm brace assembly of claim 1 wherein the first side arm coupling member comprises a side fold arm axial opening configured;

the second side arm coupling member comprises a release paddle locking slot configured to receive the release paddle locking member, a release paddle biasing member opening configured to receive and retain the release paddle biasing member, a release paddle opening configured to receive the release paddle pivot member, a release paddle axle opening configured to receive a release paddle coupling axle, and a side fold arm axial opening; and the coupling member spacing wall comprises an elastic member coupling feature.

3. The firearm brace assembly of claim 1 wherein the second side arm coupling member comprises a side fold arm axial opening configured;

the first side arm coupling member comprises a release paddle locking slot configured to receive the release paddle locking member, a release paddle biasing member opening configured to receive and retain the release paddle biasing member, a release paddle opening configured to receive the release paddle pivot member, a release paddle axle opening configured to receive a release paddle coupling axle, and a side fold arm axial opening; and the coupling member spacing wall comprises an elastic member coupling feature.

4. The firearm brace assembly of claim 1 wherein each of the first side arm coupling member and second side arm coupling member comprises a release paddle locking slot configured to receive the release paddle locking member, a release paddle biasing member opening configured to receive and retain the release paddle biasing member, a release paddle opening configured to receive the release paddle pivot member, a release paddle axle opening configured to receive a release paddle coupling axle, and a side fold arm axial opening; and the coupling member spacing wall comprises an elastic member coupling feature.

5. The firearm brace assembly of claim 4 wherein the release paddle pivot member is at least partially disposed in the release paddle opening of either the first side arm coupling member or the second side arm coupling member and coupled to the firearm coupling through the release paddle coupling axle.

6. The firearm brace assembly of claim 5 wherein the side fold arm comprises an elastic member channel disposed in the side fold arm proximal end and side arm coupling member and the elastic member is disposed therein.

7. The firearm brace assembly of claim 5 further comprising an elastic member shield coupled to the side fold arm configured to cover the elastic member.

8. The firearm brace assembly of claim 5 wherein the side arm coupling member comprises a side arm coupling member top surface, a side arm coupling member bottom surface, a side arm coupling member opening traversing the side arm coupling member top surface and side arm coupling member bottom surface, a side arm open position locking slot, a side arm closed position locking slot.

9. The firearm brace assembly of claim 8 wherein the side arm coupling member extends horizontally from a side fold arm first side.

10. The firearm brace assembly of claim 8 wherein the side arm coupling member extends horizontally from a side fold arm second side.

11. The firearm brace assembly of claim 8 wherein the side arm coupling member top surface comprises a side arm open position locking slot and a side arm closed position locking slot and the side arm coupling member top surface comprises a side arm open position locking slot and a side arm closed position locking slot.

12. The firearm brace assembly of claim 11 wherein the side arm coupling member is removably coupled to the side fold arm and in a first coupled orientation the side arm coupling member extends horizontally from a side fold arm first side and in a second coupled orientation, the side arm coupling member extends horizontally from a side fold arm second side.

13. The firearm brace assembly of claim 1 wherein the elastic member is under a higher tension in a closed assembly position and a lower tension in an open assembly position.

14. The firearm brace assembly of claim 13 wherein the elastic member is a spring.

15. The firearm brace assembly of claim 13 wherein the elastic member is an elastic band.

16. The firearm brace assembly of claim 1 wherein the rear brace member is removably coupled to the side fold arm distal end and configured to be assembled extending in a positive or negative vertical direction from the side fold arm.

17. The firearm brace assembly of claim 1 where the rear brace member is rotatably coupled to the side fold arm distal end and in an open position is locked extending vertically from the side fold arm, and in a closed position is locked extending horizontally towards the side fold arm proximal end.

18. The firearm brace assembly of claim 1 wherein the rear coupling feature comprises a picatinny rail interface.

* * * * *